US006057085A

United States Patent [19]

Sinzger et al.

[11] Patent Number: 6,057,085

[45] Date of Patent: May 2, 2000

[54] COLOR PHOTOGRAPHIC RECORDING MATERIAL

[75] Inventors: Klaus Sinzger, Leverkusen; Hans Langen, Bonn, both of Germany

[73] Assignee: Agfa-Gevaert NV, Mortsel, Belgium

[21] Appl. No.: 09/193,702

[22] Filed: Nov. 17, 1998

[30] Foreign Application Priority Data

Nov. 24, 1997 [DE] Germany ..... 197 51 947
Jul. 7, 1998 [DE] Germany ..... 198 30 219

[51] Int. Cl.[7] ..... G03C 1/46; G03C 1/83

[52] U.S. Cl. ..... 430/517; 430/522; 430/512; 430/507

[58] Field of Search ..... 430/512, 507, 430/522, 517

[56] References Cited

U.S. PATENT DOCUMENTS

| | | | |
|---|---|---|---|
| 3,740,228 | 6/1973 | Ohlschlager et al. | 96/84 |
| 4,316,013 | 2/1982 | Hunt et al. | 542/445 |
| 4,379,838 | 4/1983 | Helling et al. | 430/518 |
| 4,764,455 | 8/1988 | Arakawa et al. | 430/393 |
| 4,923,788 | 5/1990 | Shuttleworth et al. | 430/507 |
| 5,532,117 | 7/1996 | Merkel et al. | 430/504 |
| 5,719,014 | 2/1998 | Merkel et al. | 430/504 |
| 5,725,999 | 3/1998 | Merkel et al. | 430/504 |
| 5,800,971 | 9/1998 | Zengerle et al. | 430/504 |
| 5,811,228 | 9/1998 | Merkel et al. | 430/504 |

FOREIGN PATENT DOCUMENTS

| | | |
|---|---|---|
| 772 081 | 10/1996 | European Pat. Off. . |
| 2 259 746 | 10/1971 | Germany . |
| 29 41 819 | 4/1981 | Germany . |
| 1 034 044 | 1/1963 | United Kingdom . |
| 1 373 026 | 12/1971 | United Kingdom . |
| 2 077 282 | 5/1980 | United Kingdom . |
| 2 306 688 | 10/1996 | United Kingdom . |
| 92/21064 | 11/1992 | WIPO . |

*Primary Examiner*—Janet Baxter
*Assistant Examiner*—Amanda C. Walke
*Attorney, Agent, or Firm*—Connolly Bove Lodge & Hutz LLP

[57] ABSTRACT

A colour photographic material having a yellow filter layer containing at least one decolourisable dye or dye to be able to be rinsed out of the material of the formula (I)

(I)

in which $R_1$ and $R_2$ mutually independently mean a substituted or unsubstituted alkyl group, $R_3$ means a hydrogen or halogen atom, an alkyl or alkoxy group $R_4$ means a hydrogen atom, an alkyl or cyano group, $R_5$ means a dissociable group having a $pK_a$ value of between 4 and 11 and X means an oxygen or sulphur atom, is distinguished in that the dyes are non-diffusible and completely decolourisable and do not impair the properties of the silver halide emulsions.

11 Claims, No Drawings

COLOR PHOTOGRAPHIC RECORDING MATERIAL

This invention relates to a colour photographic recording material having at least one silver halide emulsion layer and a yellow filter layer which contains a yellow filter dye.

It is known to incorporate light-absorbing dyes into photographic recording materials. Such a dye may, for example, be used in a non-photosensitive layer which is arranged above a photosensitive emulsion layer or between two photosensitive emulsion layers in order to protect the underlying emulsion layers from the action of light of the wavelength absorbed by the dye. It is furthermore known to use dyes as sharpness dyes within a photosensitive emulsion layer itself or as anti-halation dyes in a layer known as an anti-halation layer.

If the spectral composition of the light incident upon a photosensitive photographic silver halide emulsion layer must be controlled, a coloured layer may be incorporated into the photosensitive photographic recording material for this purpose, the layer then being known as a filter layer. Thus, for example, in colour photographic materials a yellow coloured filter layer is usually arranged between the blue-sensitive and the underlying green-sensitive and red-sensitive layers in order to keep the blue light away from the green- or red-sensitive layers.

Stringent requirements must be placed upon the dyes used in photographic materials. On the one hand, they must exhibit spectral absorption suitable for their intended purpose. On the other, the dyes in the material should be completely and irreversibly decolourised or rinsed out of the layer, such that no unwanted colouration remains on the exposed and developed photographic material. Furthermore, the dyes should be photographically inert: in particular the dyes may exert no disadvantageous effects on the quality of the photographic silver halide emulsions.

These requirements are not satisfactorily fulfilled by known dyes. The colloidal silver conventionally used in yellow filter layers readily gives rise to fogging in adjacent emulsion layers. Water-soluble organic dyes, which are rendered non-diffusible by the introduction of long alkyl chains, as are stated, for example, in DE 2 259 746, are not or only incompletely decolourised in normal photographic processing baths. In the event of dye immobilisation with a mordant, for example GB 1,034,044, U.S. Pat. No. 3,740, 228 or DE 2 941 819, the action of the mordant is not generally sufficient to immobilise the dye to the necessary extent in the mordant layer.

While the benzoylacetonitrile or isoxazolone dyes described in U.S. Pat. No. 4,764,455, which are not converted into a water-soluble form until during processing, do indeed have suitable spectral properties and exhibit satisfactory to good resistance to diffusion, they give rise after extended storage, especially when used on transparent polyester bases, to a loss in sensitivity of the underlying green-sensitive silver halide emulsion.

While the arylidene dyes of 2(5H)-furanone described in U.S. Pat. No. 4,923,788 do indeed not exhibit the above-stated problem, they are not sufficiently resistant to diffusion and thus, especially when stored under moist and warm conditions, result in a loss in sensitivity of the overlying blue-sensitive silver halide emulsion.

The object of the invention was accordingly to provide novel, completely decolourisable yellow filter dyes which are suitable for photographic materials. A further object of the invention was moreover to provide dyes which, on the one hand, have good resistance to diffusion, and, on the other, especially when used in photographic materials having a transparent polyester base, cause no loss of sensitivity in the underlying green-sensitive emulsion.

This object is surprisingly achieved with the dyes of the formula I.

The present invention accordingly provides a colour photographic material, preferably a colour film and particularly preferably a colour negative film on a polyester base, having at least one blue-sensitive, yellow-coupling silver halide emulsion layer, at least one green-sensitive, magenta-coupling silver halide emulsion layer and at least one red-sensitive, cyan-coupling silver halide emulsion layer, wherein the blue-sensitive, yellow-coupling silver halide emulsion layer, of which there is at least one, is further away from the support than the green-sensitive, magenta-coupling silver halide emulsion layer, of which there is at least one, and the red-sensitive, cyan-coupling silver halide emulsion layer, of which there is at least one, and a yellow filter layer is provided between the blue-sensitive layer on the one hand and the green- and red-sensitive layers on the other, which filter layer contains at least one decolourisable dye or dye to be able to be rinsed out of the material of the formula I (I)

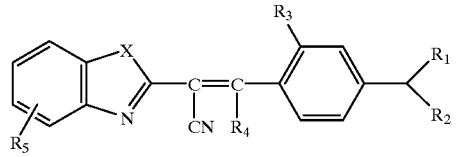

in which $R_1$ and $R_2$ mutually independently mean a substituted or unsubstituted alkyl group, $R_3$ means a hydrogen or halogen atom, an alkyl or alkoxy group $R_4$ means a hydrogen atom, an alkyl or cyano group, $R_5$ means a dissociable group having a pKa value of between 4 and 11 and X means an oxygen or sulphur atom.

$R_1$ is preferably —CH($R_6$)—Y, $R_2$ is preferably —CH($R_7$)—Z, wherein $R_6$ and $R_7$ mutually independently mean a hydrogen atom or an alkyl group and Y and Z mutually independently mean hydrogen or a substituent, wherein the following applies:

$$\sigma_m(Y) + \sigma_m(Z)/2 \geq -0{,}1$$

$\sigma_m$ are the Hammett constants of substituents. A definition and review are given in C. Hansch et al. Chem. Rev. 1991, pages 165–195.

The ability of the dyes to be decolourized is obtained particlularly by dyes which have no bulky substituents, like those described in GB 2 306 688.

The substituents in particular have the following meaning:

$R_3$: H or $CH_3$ $R_4$: H or $CH_3$ $R_5$: —COOH, —$NHSO_2R_8$, —$SO_2NHCOR_8$, $R_6$: H or $CH_3$ $R_7$: H or $CH_3$ $R_8$: $C_1$–$C_6$ alkyl Y and Z mutually independently: H, alkyl, alkoxycarbonyl, alkoxyalkyl, arylsulphonylaminoalkyl, cyanoalkyl, alkylaminosulphonylalkyl.

Y and Z are preferably identical.

Examples of compounds of the formula I are:

Suitable dyes with $R_1$=—CH($R_6$)—Y and $R_2$—CH($R_7$)Z are:

| dye-stuff | X | $R_6$ | $R_7$ | $R_3$ | $R_4$ | $R_5$ | Y |
|---|---|---|---|---|---|---|---|
| I-1 | O | H | H | H | H | 5-COOH | H |
| I-2 | O | H | H | H | H | 5-COOH | $CH_3$ |
| I-3 | O | H | H | H | H | 5-COOH | $CH_2$—O—$C_2H_5$ |
| I-4 | O | H | H | H | H | 6-COOH | $CH_2$—NH—$SO_2$—$C_6H_4$—$CH_3$ |
| I-5 | O | H | H | $CH_3$ | H | 5-COOH | $CO_2$—$C_3H_7$ |
| I-6 | O | H | H | $CH_3$ | H | 5-COOH | $CO_2$—[CH($CH_3$)—$CH_2$—O]$_2$—C($CH_3$)$_3$ |
| I-7 | O | $CH_3$ | H | $CH_3$ | H | 6-COOH | $CO_2$—$CH_2CH_2$—O—$C_4H_9$ |
| I-8 | O | H | H | $CH_3$ | H | 5-NH—$SO_2$—$C_4H_9$ | $CH_2$—CN |
| I-9 | O | H | H | $CH_3$ | H | 5-NH—$SO_2$—$CH_3$ | $CH_2$—CN |
| I-10 | O | H | H | H | H | 5-$SO_2$—NH—CO—$C_2H_5$ | $CH_2$—O—$CH_2CH_2$—O—$C_2H_5$ |
| I-11 | O | H | H | $CH_3$ | H | 5-COOH | $CH_2$—$SO_2$—NH—($CH_2$)$_3$—O—CH($CH_3$)$_2$ |
| I-12 | O | H | H | H | $CH_3$ | 5-COOH | H |
| I-13 | S | H | H | H | H | 5-NH—$SO_2$—$CH_3$ | H |
| I-14 | S | H | H | H | H | 5-COOH | $CH_3$ |
| I-15 | S | H | H | H | H | 5-COOH | $CH_2$—O—$C_2H_5$ |
| I-15 | S | H | H | H | H | 5-NH—$SO_2$—$CH_3$ | $CH_2$—NH—$SO_2$—$C_6H_4$—$CH_3$ |
| I-17 | S | H | H | $CH_3$ | H | 5-COOH | $CO_2$—$C_3H_7$ |
| I-18 | S | H | H | $CH_3$ | H | 6-COOH | $CO_2$—[CH($CH_3$)—$CH_2$—O]$_2$—C($CH_3$)$_3$ |
| I-19 | S | $CH_3$ | H | $CH_3$ | H | 5-COOH | $CO_2$—$CH_2CH_2$—O—$C_4H_9$ |
| I-20 | S | H | H | $CH_3$ | H | 5-NH—$SO_2$—$C_4$—$H_9$ | $CH_2$—CN |
| I-21 | S | H | H | $CH_3$ | H | 6-NH—$SO_2$—$CH_3$ | $CH_2$—CN |
| I-22 | S | H | H | H | H | 5-$SO_2$—NH—CO—$C_2$—$H_5$ | $CH_2$—O—$CH_2CH_2$—O—$C_2H_5$ |
| I-23 | S | H | H | $CH_3$ | H | 5-COOH | $CH_2$—$SO_2$—NH—($CH_2$)$_3$—O—CH($CH_3$)$_2$ |
| I-24 | S | H | H | H | $CH_3$ | 5-COOH | H |

| dye-stuff | Z |
|---|---|
| I-1 | H |
| I-2 | $CH_3$ |
| I-3 | $CH_2$—O—$C_2H_5$ |
| I-4 | $CH_2$—NH—$SO_2$—$C_6H_4$—$CH_3$ |
| I-5 | $CO_2$—$C_3H_7$ |
| I-6 | $CO_2$—[CH($CH_3$)—$CH_2$—O]$_2$—C($CH_3$)$_3$ |
| I-7 | $CH_2$—O—$C_2H_5$ |
| I-8 | $CH_2$—CN |
| I-9 | $CH_2$—O—$CH_2CH_2$—O—$C_2H_5$ |
| I-10 | $CH_2$—O—$CH_2CH_2$—O—$C_2H_5$ |
| I-11 | $CH_2$—$SO_2$—NH—($CH_2$)$_3$—O—CH($CH_3$)$_2$ |
| I-12 | H |
| I-13 | H |
| I-14 | $CH_3$ |
| I-15 | $CH_2$—O—$C_2H_5$ |
| I-15 | $CH_2$—NH—$SO_2$—$C_6H_4$—$CH_3$ |
| I-17 | $CO_2$—$C_3H_7$ |
| I-18 | $CO_2$—[CH($CH_3$)—$CH_2$—O]$_2$—C($CH_3$)$_3$ |
| I-19 | $CH_2$—O—$C_2H_4$ |
| I-20 | $CH_2$—CN |
| I-21 | $CH_2$—O—$CH_2CH_2$—O—$C_2H_5$ |
| I-22 | $CH_2$—O—$CH_2CH_2$—O—$C_2H_5$ |
| I-23 | $CH_2$—$SO_2$—NH—($CH_2$)$_3$—O—CH($CH_3$)$_2$ |
| I-24 | H |

Examples of colour photographic materials are colour negative films, colour reversal films, colour positive films, colour photographic paper, colour reversal photographic paper, colour-sensitive materials for the dye diffusion transfer process or the silver dye bleaching process.

The photographic materials consist of a support onto which at least one photosensitive silver halide emulsion layer is applied. Thin films and sheets are in particular suitable as supports. A review of support materials and the auxiliary layers applied to the front and reverse sides of which is given in Research Disclosure 37254, part 1 (1995), page 285 and in Research Disclosure 38957, part XV (1996), page 627. Polyester films, in particular made from polyethylene naphthalate, having a layer on the reverse side for magnetic recordings may also be considered as supports.

The colour photographic materials conventionally contain at least one red-sensitive, one green-sensitive and one blue-sensitive silver halide emulsion layer, optionally together with interlayers and protective layers.

Depending upon the type of the photographic material, these layers may be differently arranged. This is demonstrated for the most important products:

Colour photographic films such as colour negative films and colour reversal films have on the support, in the stated sequence, 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers. The layers of identical spectral sensitivity differ with regard to their photographic sensitivity, wherein the less sensitive sub-layers are generally arranged closer to the support than the more highly sensitive sub-layers.

The yellow filter layer, which prevents blue light from reaching the underlying layers, is conventionally located between the green-sensitive and blue-sensitive layers. Possible options for different layer arrangements and the effects thereof on photographic properties are described in J. Inf. Rec. Mats., 1994, volume 22, pages 183–193 and in Research Disclosure 38957, part XI (1996), page 624.

Colour photographic paper, which is usually substantially less photosensitive than a colour photographic film, conventionally has on the support, in the stated sequence, one blue-sensitive, yellow-coupling silver halide emulsion layer, one green-sensitive, magenta-coupling silver halide emulsion layer and one red-sensitive, cyan-coupling silver halide emulsion layer; the yellow filter layer may be omitted.

The number and arrangement of the photosensitive layers may be varied in order to achieve specific results. For example, all high sensitivity layers may be grouped together in one package of layers and all low sensitivity layers may be grouped together in another package of layers in order to increase sensitivity (DE-25 30 645).

The substantial constituents of the photographic emulsion layers are binder, silver halide grains and colour couplers.

Details of suitable binders may be found in Research Disclosure 37254, part 2 (1995), page 286 and in Research Disclosure 38957, part IIA (1996), page 598.

Details of suitable silver halide emulsions, the production, ripening, stabilisation and spectral sensitisation thereof, including suitable spectral sensitisers, may be found in Research Disclosure 37254, part 3 (1995), page 286 and in Research Disclosure 37038, part XV (1995), page 89 and in Research Disclosure 38957, part VA (1996), page 603.

Photographic materials with camera sensitivity conventionally contain silver bromide-iodide emulsions, which may optionally also contain small proportions of silver chloride. Photographic print materials contain either silver chloride-bromide emulsions with up to 80 mol. % of AgBr or silver chloride-bromide emulsions with above 95 mol. % of AgCl.

Details relating to colour couplers may be found in Research Disclosure 37254, part 4 (1995), page 288, in Research Disclosure 37038, part II (1995), page 80 and in Research Disclosure 38957, part XB (1996), page 616. The maximum absorption of the dyes formed from the couplers and the developer oxidation product is preferably within the following ranges: yellow coupler 430 to 460 nm, magenta coupler 540 to 560 nm, cyan coupler 630 to 700 nm.

In order to improve sensitivity, grain, sharpness and colour separation in colour photographic films, compounds are frequently used which, on reaction with the developer oxidation product, release photographically active compounds, for example DIR couplers which eliminate a development inhibitor.

Details relating to such compounds, in particular couplers, may be found in Research Disclosure 37254, part 5 (1995), page 290, in Research Disclosure 37038, part XIV (1995), page 86 and in Research Disclosure 38957, part XC (1996), page 618.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present in the layers as fine droplets (0.05 to 0.8 $\mu$m in diameter).

Suitable high-boiling organic solvents, methods for the introduction thereof into the layers of a photographic material and further methods for introducing chemical compounds into photographic layers may be found in Research Disclosure 37254, part 6 (1995), page 292.

The non-photosensitive interlayers generally located between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in Research Disclosure 37254, part 7 (1995), page 292, in Research Disclosure 37038, part III (1995), page 84 and in Research Disclosure 38957, part XD (1996), page 621.

The photographic material may also contain UV light absorbing compounds, optical brighteners, spacers, filter dyes, formalin scavengers, light stabilisers, anti-oxidants, $D_{min}$ dyes, additives to improve stabilisation of dyes, couplers and whites and to reduce colour fogging, plasticisers (latices), biocides and others.

Suitable compounds may be found in Research Disclosure 37254, part 8 (1995), page 292, in Research Disclosure 37038, parts IV, V, VI, VII, X, XI and XIII (1995), pages 84 et seq. and in Research Disclosure 38957, parts VI, VIII, IX and X (1996), pages 607 and 610 et seq.

The layers of colour photographic materials are conventionally hardened, i.e. the binder used, preferably gelatine, is crosslinked by appropriate chemical methods.

Suitable hardener substances may be found in Research Disclosure 37254, part 9 (1995), page 294, in Research Disclosure 37038, part XII (1995), page 86 and in Research Disclosure 38957, part IIB (1996), page 599.

Once exposed with an image, colour photographic materials are processed using different processes depending upon their nature. Details relating to processing methods and the necessary chemicals are disclosed in Research Disclosure 37254, part 10 (1995), page 294, in Research Disclosure 37038, parts XVI to XXIII (1995), pages 95 et seq. and in Research Disclosure 38957, parts XVIII, XIX and XX (1996), pages 630 et seq. together with example materials.

Production of Dye I-1

2.0 g of 5-carboxy-2-cyanomethylbenzoxazole and 1.5 g of p-dimethylaminobenzaldehyde in 50 ml of ethanol are refluxed for 1 hour. After cooling, the dye is filtered and rewashed with a little cold ethanol. After drying, 3.0 g of I-1 are obtained as an amorphous red solid.

Production of Dye I-21

2.2 g of 5-methylsulphamoyl-2-cyanomethylbenzothiazole and 3.0 g of 4-{N-[2-(2-ethoxyethoxy) ethyl]-N-(2-cyanoethyl)amino}-2-methylbenzaldehyde in 50 ml of ethanol are refluxed for 1 hour. After cooling, the dye is filtered and rewashed with a little cold ethanol. After drying, 3.3 g of I21 are obtained as an amorphous yellow solid.

General Instructions For Production of Dye Emulsions (OFD)

1 to 2 g of dye are dissolved together with 2 g of tricresyl phosphate, 0.3 g of triphenylphosphine oxide and 0.3 g of oxform scavenger SC-2 in 10 ml of ethyl acetate and emulsified in a high-speed stirrer at 50° C. in 150 g of a 5 wt. % aqueous gelatine solution, which has been combined with 0.1 g of a wetting agent. The ethyl acetate is then stripped out under a vacuum. The dispersion, which is still liquid, is solidified by adjusting it to 6° C.

General Instructions For Production of Solid Particle Dispersions (SPD)

3 to 6 g of dye are ground together with 75 ml of a 2 wt. % aqueous gelatine solution and 1.5 g of the wetting agent for 14 hours in a mill containing 300 g of zirconium oxide beads of a diameter of 0.8 to 1.0 mm. The zirconium oxide beads are removed by suction filtration and washed with 159 ml of water, the dye dispersion stirred into 52 g of 20 wt. % aqueous gelatine and made up to 300 g with water. The dispersion is then solidified at 6° C.

EXAMPLE

A colour photographic recording material for colour negative development was produced by applying the following layers in the stated sequence onto a polyethylene naphthalate (PEN) film base having a thickness of 90 μm and provided on the front side with a coupling layer and on the reverse side with a magnetic recording layer (quantities in g/m$^2$):

Example 1.1

The silver halide application rate is stated as the corresponding quantities of $AgNO_3$; the silver halides are stabilised with 0.5 g of 4-hydroxy-6-methyl-1,3,3a,7-tetraazaindene per mole of $AgNO_3$.

1st layer (Anti-halo layer)

- 0.3 g of black colloidal silver
- 1.2 g of gelatine
- 0.3 g of UV absorber UV-1
- 0.2 g of oxform scavenger SC-1
- 0.02 g of tricresyl phosphate (TCP)

2nd layer (Low sensitivity, red-sensitive layer)

- 0.7 g of $AgNO_3$ of a spectrally red-sensitised Ag(Br,I) emulsion containing 4 mol. % iodide, average grain diameter 0.42 μm
- 1.0 g of gelatine
- 0.35 g of colourless coupler C-1
- 0.05 g of coloured coupler RC-1
- 0.03 g of coloured coupler YC-1
- 0.36 g of TCP 3rd layer (Medium sensitivity, red-sensitive layer)

- 0.8 g of $AgNO_3$ of a spectrally red-sensitised Ag(Br,I) emulsion, 5 mol. % iodide, average grain diameter 0.53 μm
- 0.6 g of gelatine
- 0.15 g of colourless coupler C-2
- 0.02 g of DIR coupler D-1
- 0.03 g of coloured coupler RC-1
- 0.18 g of TCP 4th layer (High sensitivity, red-sensitive layer)

- 1.0 g of $AgNO_3$ of a spectrally red-sensitised Ag(Br,I) emulsion, 6 mol. % iodide, average grain diameter 0.85 μm
- 1.0 g of gelatine
- 0.10 g of colourless coupler C-2
- 0.005 g of DIR coupler D-2
- 0.11 g of TCP 5th layer (Interlayer)

- 0.8 g of gelatine
- 0.07 g of oxform scavenger SC-2
- 0.06 g of aurintricarboxylic acid, aluminium salt 6th layer (Low sensitivity, green-sensitive layer)

- 0.7 g of $AgNO_3$ of a spectrally green-sensitised Ag(Br,I) emulsion, 4 mol. % iodide, average grain diameter 0.35 μm
- 0.8 g of gelatine
- 0.22 g of colourless coupler M-1
- 0.02 g of DIR coupler D-3
- 0.065 g of coloured coupler YM-1
- 0.20 g of TCP 7th layer (Medium sensitivity, green-sensitive layer)

- 0.9 g of $AgNO_3$ of a spectrally green-sensitised Ag(Br,I) emulsion, 4 mol. % iodide, average grain diameter 0.50 μm
- 1.0 g of gelatine -continued

- 0.16 g of colourless coupler M-1
- 0.015 g of DIR coupler D-4
- 0.040 g of coloured coupler YM-1
- 0.14 g of TCP 8th layer (High sensitivity, green-sensitive layer)

- 0.6 g of $AgNO_3$ of a spectrally green-sensitised Ag(Br,I) emulsion, 6 mol. % iodide, average grain diameter 0.70 μm
- 1.1 g of gelatine
- 0.05 g of colourless coupler M-2
- 0.01 g of coloured coupler YM-2
- 0.02 g of DIR coupler D-5
- 0.08 g of TCP 9th layer (Yellow filter layer)

- 0.05 g of PVP
- 1.0 g of gelatine
- 0.08 g of oxform scavenger SC-2
- 0.26 g of TCP 10th layer (Low sensitivity, blue-sensitive layer)

- 0.3 g of $AgNO_3$ of a spectrally blue-sensitised Ag(Br,I) emulsion, 6 mol. % iodide, average grain diameter 0.44 μm
- 0.5 g of a spectrally blue-sensitised Ag(Br,I) emulsion, 6 mol. % iodide, average grain diameter 0.50 μm
- 1.9 g of gelatine
- 1.1 g of colourless coupler Y-1
- 0.037 g of DIR coupler D-6
- 0.6 g of TCP 11th layer (High sensitivity, blue-sensitive layer)

- 0.6 g of $AgNO_3$ of a spectrally blue-sensitised Ag(Br,I) emulsion, 7 mol. % iodide, average grain diameter 0.95 μm
- 1.2 g of gelatine
- 0.10 g of colourless coupler Y-1
- 0.006 g of DIR coupler D-7
- 0.11 g of TCP 12th layer (Micrate layer)

- 0.10 g of $AgNO_3$ of a micrate Ag(Br,I) emulsion, average grain diameter 0.06 μm, 0.5 mol. % iodide
- 1.0 g of gelatine
- 0.004 mg of $K_2[PdCl_4]$
- 0.4 g of UV absorber UV-2
- 0.3 g of TCP 13th layer (Protective & hardening layer)

- 0.25 g of gelatine
- 0.75 g of hardener H-1

Once hardened, the overall layer structure had a swelling factor of ≦3.5.

Substances used in Example 1:
UV-1
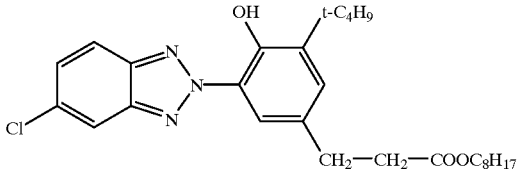
UV-2
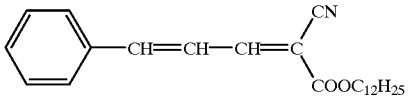
C-1
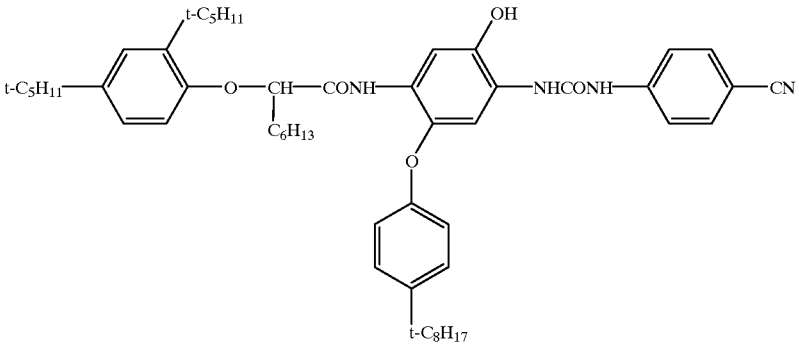
C-2
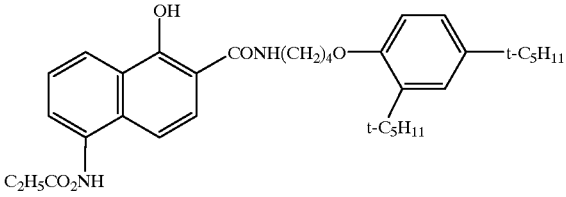
RC-1
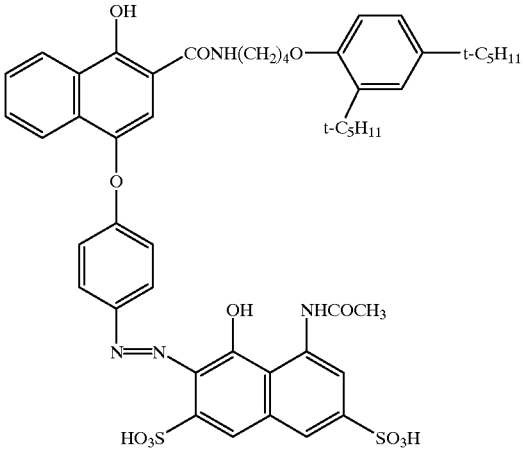

-continued
M-1
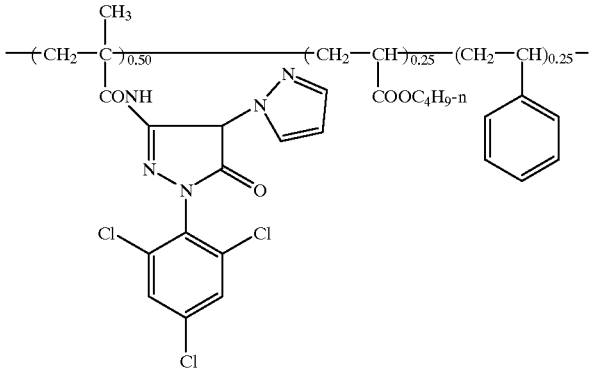
M-2
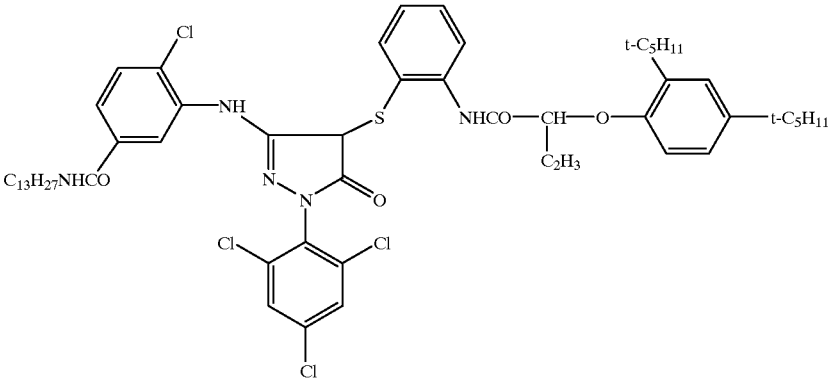
YM-1
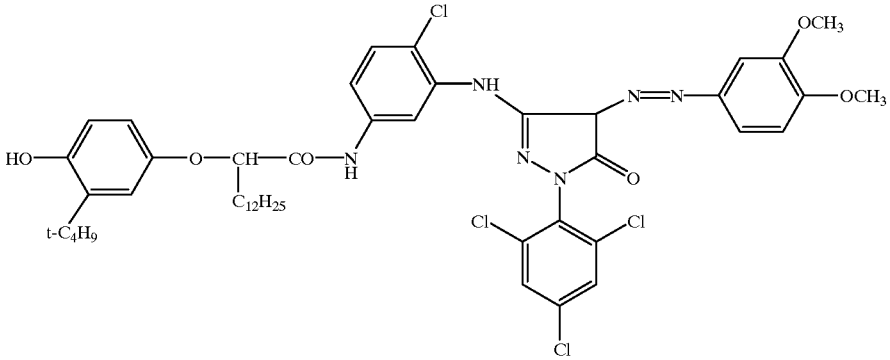
YM-2
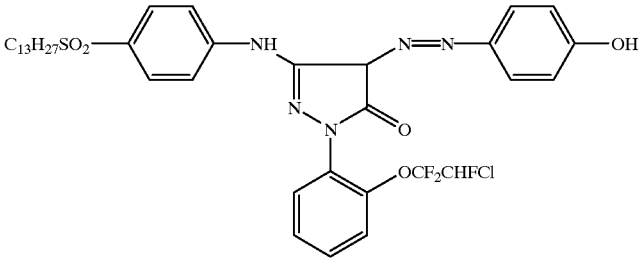

-continued
Y-1
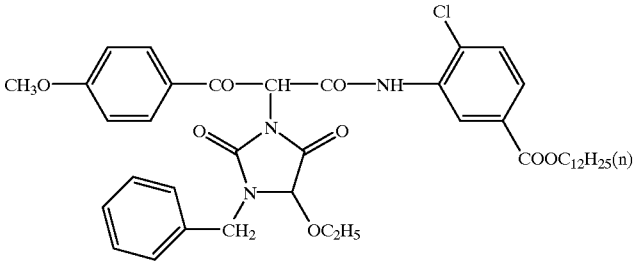
D-1
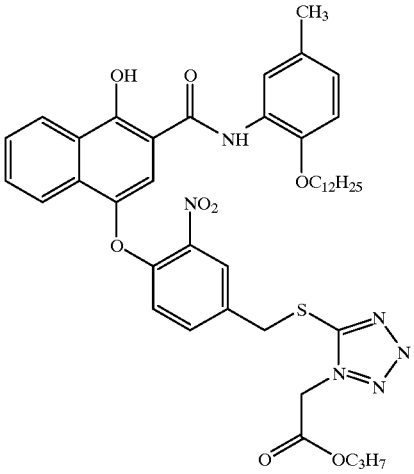
D-2
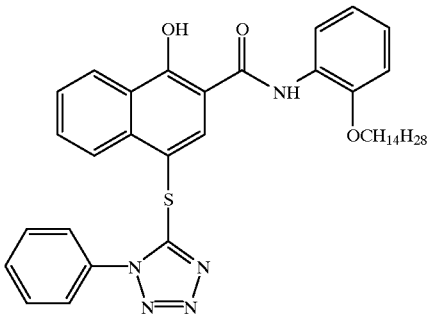
D-3
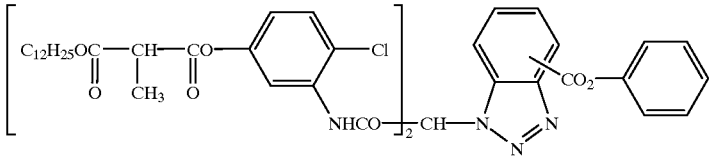
D-4
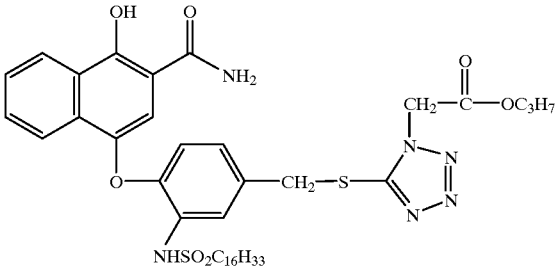

-continued
D-5
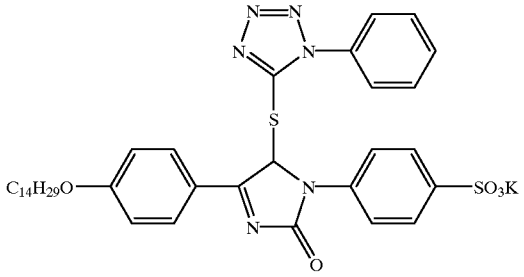
D-6
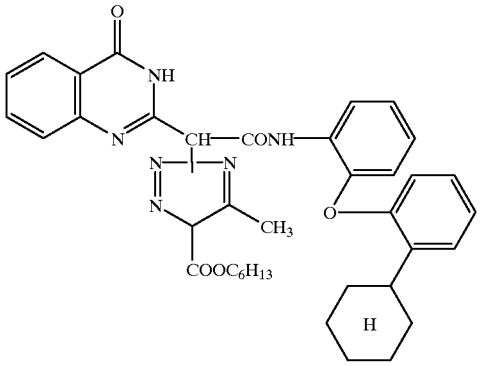
D-7
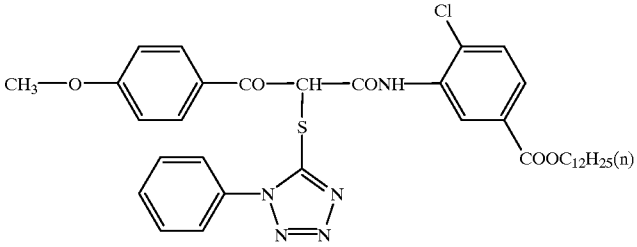
YC-1
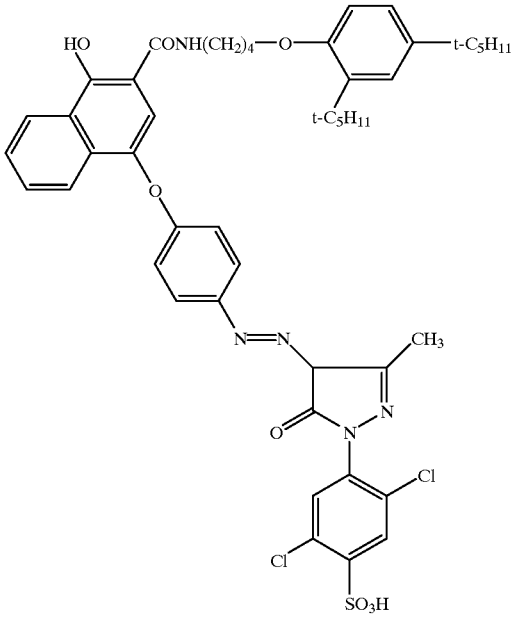

-continued

SC-1

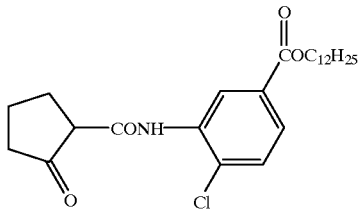

SC-2

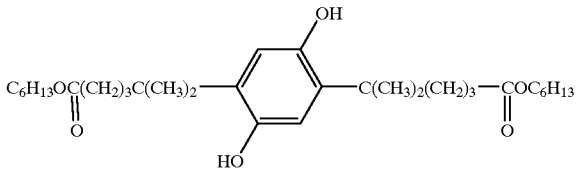

H-1

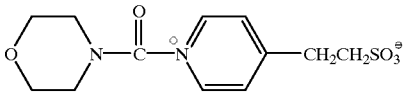

Examples 1.2 to 1.11 analogous to Example 1.1 were produced by introducing the filter dyes listed in the table into the 9th layer.

After exposure with a grey wedge, development was performed in accordance with *The British Journal of Photography,* 1974, pages 597 and 598.

The sensitometric differences which are also described in table 1 were found. It is clearly evident that the yellow dyes according to the invention are completely removed during processing, exhibit a distinctly lower loss of sensitivity in the green spectral range after 12 months' storage (in log H units; discernible from ΔE(green)) and, even after 7 days at 35° C., 90% relative humidity, almost all diffuse considerably less into the blue-sensitive layer package (discernible from ΔE(blue)).

| Material | Dye | log $P_{(o/w)}$* | Form incorporated | Quantity mg/m$^2$ | ΔDmin vs 1.1 | ΔE (green)** | DE (blue)*** | Status |
|---|---|---|---|---|---|---|---|---|
| 1.1 | — | — | — | — | — | −0.02 | −0.02 | Comparison |
| 1.2 | GF-1 | >5 | OFD | 171 | 0.02 | −0.15 | −0.03 | Comparison |
| 1.3 | GF-2 | <5 | OFD | 201 | 0.01 | −0.13 | −0.15 | Comparison |
| 1.4 | GF-3 | <5 | OFD | 169 | 0.00 | −0.03 | −0.25 | Comparison |
| 1.5 | GF-3 | <5 | SPD | 169 | 0.00 | −0.02 | −0.21 | Comparison |
| 1.6 | I-1 | <5 | SPD | 77 | 0.00 | −0.02 | −0.07 | Invention |
| 1.7 | 1-6 | <5 | OFD | 181 | 0.01 | −0.03 | −0.05 | Invention |
| 1.8 | I-10 | <5 | OFD | 149 | 0.01 | −0.02 | −0.03 | Invention |
| 1.9 | I.22 | <5 | OFD | 153 | 0.00 | −0.03 | −0.04 | Invention |
| 1.10 | GF-4 | >5 | OFD | 150 | 0.65 | −0.02 | −0.02 | Comparison |
| 1.11 | GF-5 | >5 | OFD | 126 | 0.62 | −0.02 | −0.03 | Comparison |

*log $P_{(o/w)}$ is the decimal logarithm of the distribution coefficient of a substance in the n-octanol/water two phase system.
**after 12 months' storage under normal room conditions
***after 7 days' storage at 35° C./90% relative humidity

GF-1

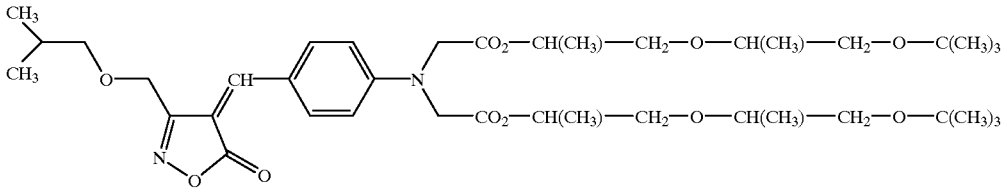

-continued

GF-2

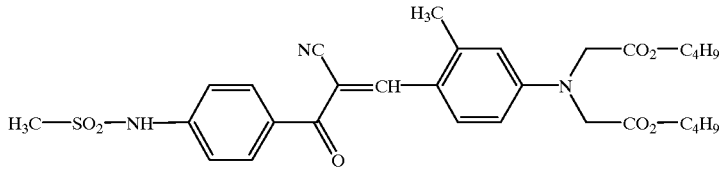

GF-3

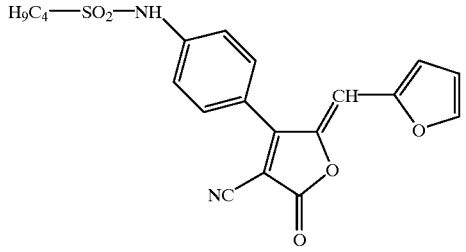

GF-4

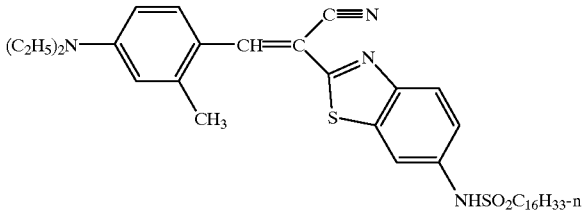

GF-5

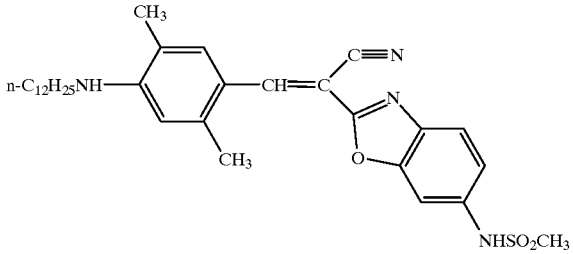

We claim:

1. A color photographic material which comprises at least one blue-sensitive, yellow-coupling silver halide emulsion layer, at least one green-sensitive, magenta-coupling silver halide emulsion layer and at least one red-sensitive, cyan-coupling silver halide emulsion layer, wherein the blue-sensitive, yellow-coupling silver halide emulsion layer, of which there is at least one, is further away from the support than the green-sensitive, magenta-coupling silver halide emulsion layer, of which there is at least one, and the red-sensitive, cyan-coupling silver halide emulsion layer, of which there is at least one, and a yellow filter layer is provided between the blue-sensitive layer and both the green- and red-sensitive layers which filter layer contains at least one decolorizable dye or dye to be able to be rinsed out of the material of the formula I (I)

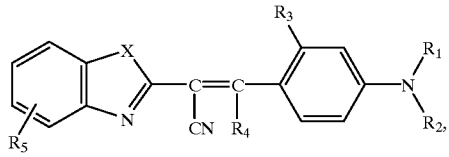

in which $R_1$ and $R_2$ mutually independently are a substituted or unsubstituted alkyl group, $R_3$ is means a hydrogen or halogen atom, an alkyl or alkoxy group $R_4$ is a hydrogen atom, an alkyl or cyano group, $R_5$ is —COOH or $SO_2$ $NHCOR_8$.

$R_8$ is $C_1$ to $C_6$ alkyl and

X is an oxygen or sulphur atom.

2. The color photographic material according to claim 1, wherein $R_1$ is —$CH(R_6)$-Y $R_2$ is —$CH(R_7)$-Z $R_6$ and $R_7$ mutually independently are a hydrogen atom or an alkyl group and Y and Z mutually independently are hydrogen or a substitutent, wherein the following applies:

$$\sigma_m(Y)+\sigma_m(Z)/2 \geqq -0.1.$$

3. The color photographic material according to claim 2, wherein $R_3$ is H or $CH_3$, $R_4$ is H or $CH_3$, $R_6$ is H or $CH_3$, $R_7$ is H or $CH_3$, Y and Z are mutually independently: H, alkyl, alkoxycarbonyl, alkoxyalkyl, arylsulphonylaminoalkyl, cyanoalkyl or alkylaminosulphonylalkyl.

4. The photographic recording material according to claim 3, wherein X is oxygen.

5. The color photographic recording material according to claim 3, wherein X is sulfur.

6. The color photographic recording material according to claim 4, wherein $R_4$, $R_6$, and $R_7$ are hydrogen.

7. The color photographic recording material according to claim 5, wherein $R_4$, $R_6$, and $R_7$ are hydrogen.

8. The color photographic recording material according to claim 6, wherein $R_3$ is hydrogen.

9. The color photographic recording material according claim 7, wherein $R_3$ is hydrogen.

10. The color photographic recording material according claim 6, wherein $R_3$ is $CH_3$.

11. The color photographic recording material according claim 7, wherein $R_3$ is $CH_3$.

* * * * *